United States Patent [19]

Jankelewitz et al.

[11] 4,114,933

[45] Sep. 19, 1978

[54] LOCK STRUCTURE

[76] Inventors: Eliezer Jankelewitz, 775 Lawrence Ave. West, Apt. 10, Toronto, Ontario, Canada, M6A 1C2; John Pinhas Benedict, 7026 Kelder St. Coute St. Luke, Montreal, Quebec, Canada

[21] Appl. No.: 828,288

[22] Filed: Aug. 29, 1977

[51] Int. Cl.[2] ..... E05C 1/06

[52] U.S. Cl. ..... 292/37; 70/108

[58] Field of Search ..... 292/5, 6, 27, 49, 34, 292/36, 37, 38, 43; 70/103, 118, 119, 120, 107, 108, 109, 110, 111

[56] References Cited

U.S. PATENT DOCUMENTS

| | | | |
|---|---|---|---|
| 932,383 | 8/1909 | Furman et al. | 70/120 |
| 950,551 | 3/1910 | Ledoux | 292/37 |
| 1,341,038 | 5/1920 | Bickel | 70/120 X |
| 1,485,024 | 2/1924 | Gage | 70/118 |
| 1,607,038 | 11/1926 | Baron | 70/118 |
| 1,635,714 | 7/1927 | Hoffmann | 292/37 X |
| 2,124,758 | 7/1938 | Bates et al. | 292/6 X |
| 2,125,227 | 7/1938 | Hammarle | 292/37 X |
| 2,188,532 | 1/1940 | Dominguez | 70/108 |
| 2,473,065 | 6/1949 | Miller | 292/37 |
| 4,037,440 | 7/1977 | Shabtai et al. | 70/108 |
| 4,046,410 | 9/1977 | Connell | 292/36 |

FOREIGN PATENT DOCUMENTS

| | | | |
|---|---|---|---|
| 384,615 | 11/1923 | Fed. Rep. of Germany | 70/107 |

*Primary Examiner*—Thomas J. Holko

[57] ABSTRACT

The specification describes a lock provided with first locking means, second locking means and rotatable operating means for operating the first and second locking means. The arrangement is such that when the operating means is rotated in one direction from a first position in which the first locking means is in a locking position and the second locking means is in an unlocking position, the first locking means is moved to the unlocking position without disturbing the second locking means. When the operating means is rotated in the opposite direction from the first position, the first locking means remains in the locking position while the second locking means is moved to the locking position.

17 Claims, 11 Drawing Figures

LOCK STRUCTURE

FIELD OF THE INVENTION

This invention relates to a lock adapted for maximum security use when so desired.

BACKGROUND OF THE INVENTION

Buildings which are left unattended over extended periods of time, are often subject to burglary and theft, due to the ease with which they can be broken in to. The primary method of breaking and entering especially in cases where windows are not easily accessible, is through the building door.

Most building doors are provided with a standard lock arrangement in which a retractable latch is operated by a door knob rotatable in either direction for withdrawing the latch. For an experienced burglar, such a lock presents little or no obstacle to entering the building. The latch can easily be retracted or in some cases the exposed door hinges can be removed and the entire door is simply lifted out of the way.

According to the present invention, a lock is provided with first locking means comparable to the standard latch arrangement of a conventional lock. However, the present lock also includes second locking means and rotatable operating means for operating both the first and second locking means. When the operating means is rotated in one direction from a first position in which the first locking means is in a locking position and the second locking means is in an unlocking position, the first locking means is moved to the unlocking position without disturbing the second locking means. However, when the rotatable operating means is rotated in the opposite direction from the first position, the first locking means is maintained in its locking position and the second locking means is moved to a locking position.

BRIEF DESCRIPTION OF THE DRAWINGS

The above mentioned, as well as other advantages and features of the present invention will become apparent in the following detailed description of the preferred embodiments according to this invention, wherein.

DETAILED DESCRIPTION OF THE PREFERRED EMBODIMENTS

Figure 1:
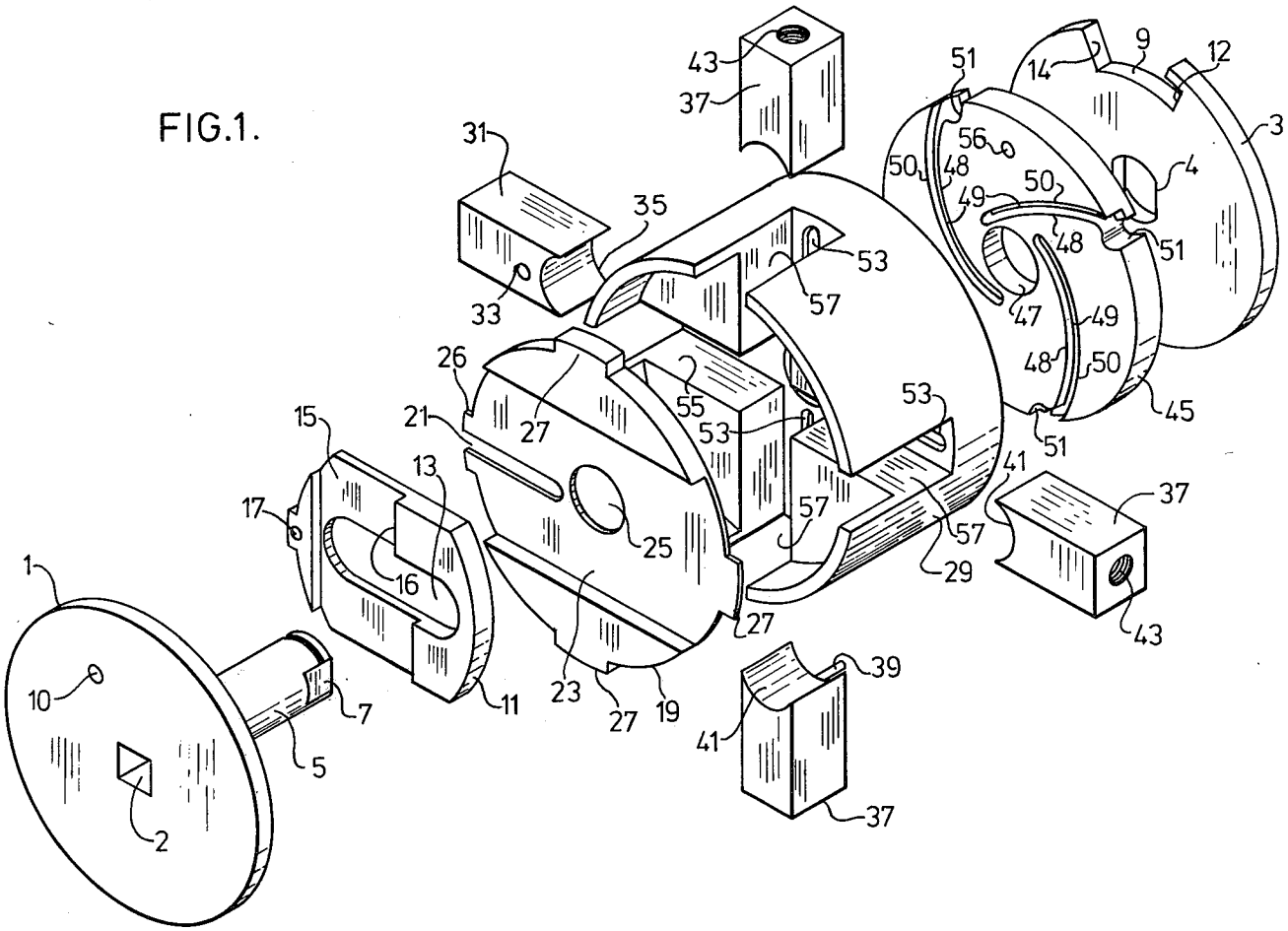
FIG. 1 is an exploded elevational front perspective view of a preferred embodiment of the lock.
Figure 2:
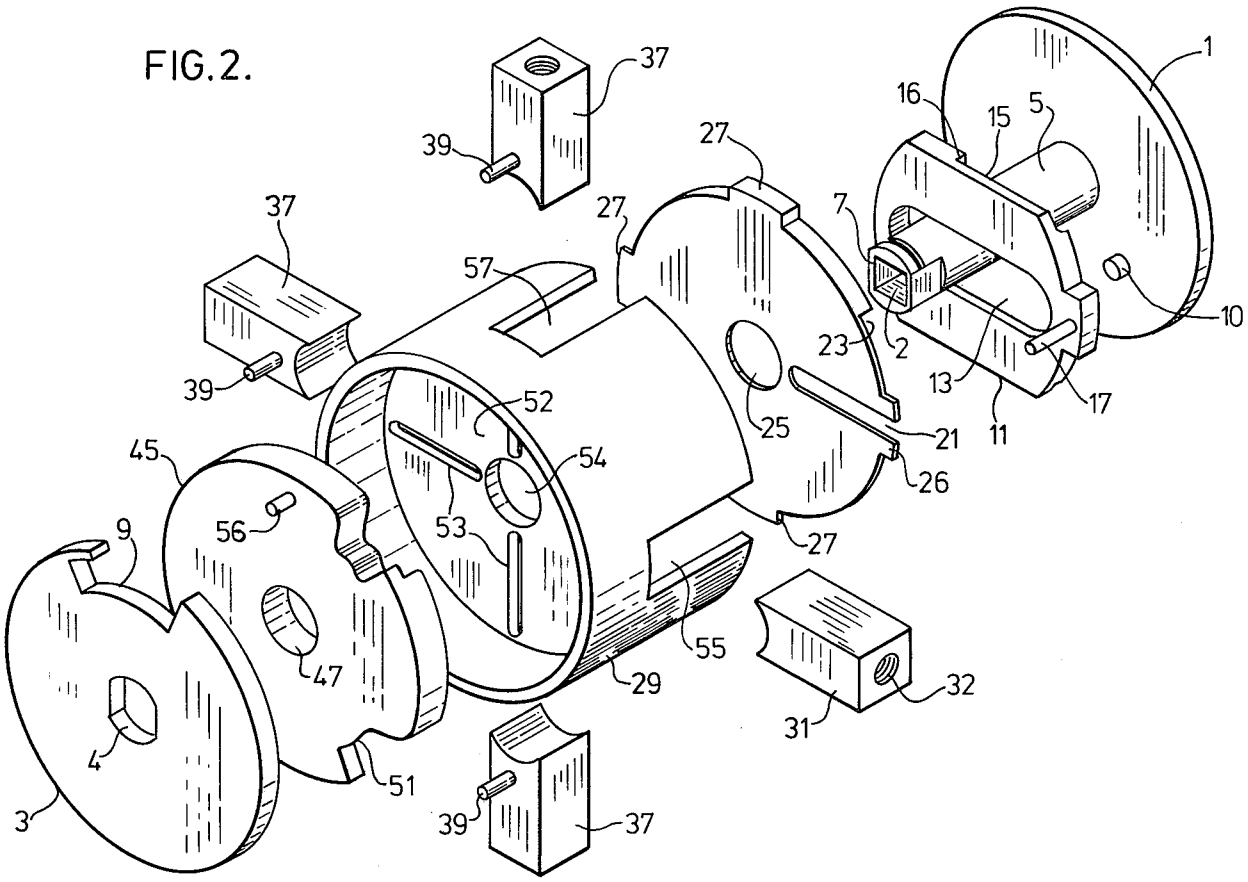
FIG. 2 is an exploded elevational rear perspective view of the lock shown in FIG. 1.
Figure 3:
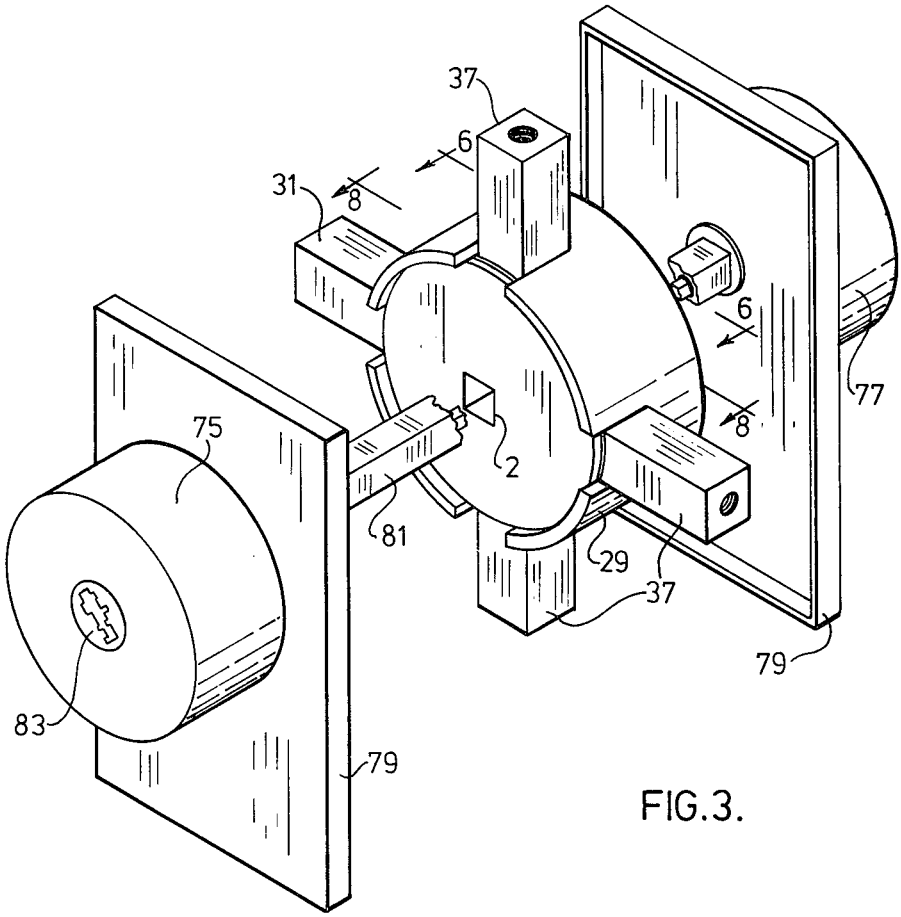
FIG. 3 is a perspective view looking down on the lock shown in FIGS. 1 and 2 when assembled.

As best shown in FIGS. 1 and 2, the lock includes a first plate 1, a second plate 3 and a rounded shaft 5 extending between and secured to the two plates. The rectangular end 7 of shaft 5 is secured within a correspondingly shaped aperture 4 in plate 3. Plates 1 and 3 are preferably circular in shape for purposes of rotating within the lock housing 29. According to this embodiment, plates 1 and 3 are provided at opposing ends of the lock housing. Plates 1 and 3 and shaft 5 form part of the rotatable operating means of the lock. The remaining components of the operating means are shown in FIG. 3 and include rotatable door knobs 75 and 77 and rectangular shaft 81, fitted within rectangular aperture 2 extending through rounded shaft 5. As will be apparent from the drawings, plate 1 and plate 3 rotate with one another during operation of the lock.

Fitted over shaft 5 and forming part of the first locking means, is a sliding plate 11. Rounded shaft 5 penetrates slot 13 provided in plate 11. The sliding plate includes a recessed portion 15 having an end wall 16. The plate is also provided with pin 17 which extends through slot 21 provided in housing component 19 into orifice 33 provided on latch member component 31, which also forms part of the first locking means. Plate 11 slides within groove 23 provided in housing component 19. The housing component is secured against rotation within housing 29 by means of lugs 26 and 27 fitted within correspondingly shaped openings in the housing. Housing component 19 also includes a rounded central aperture 25 through which rounded shaft 5 extends.

Figure 4:
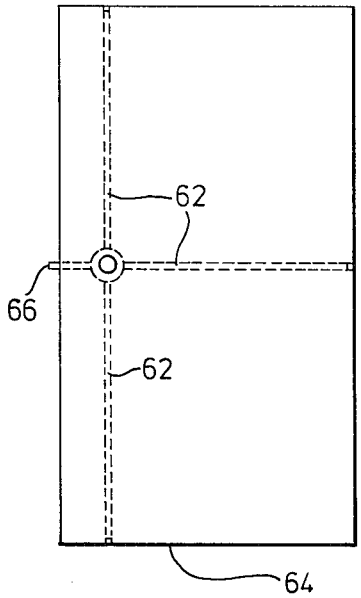
FIG. 4 shows the lock of FIG. 3 installed in a door with the first locking means in a locking position and the second locking means in an unlocking position.
Figure 5:
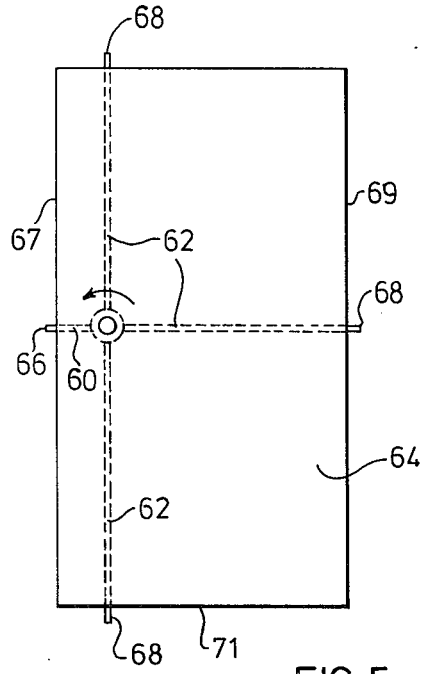
FIG. 5 is a view similar to FIG. 4 with the exception that the second locking means is in the locking position.
Figure 10:
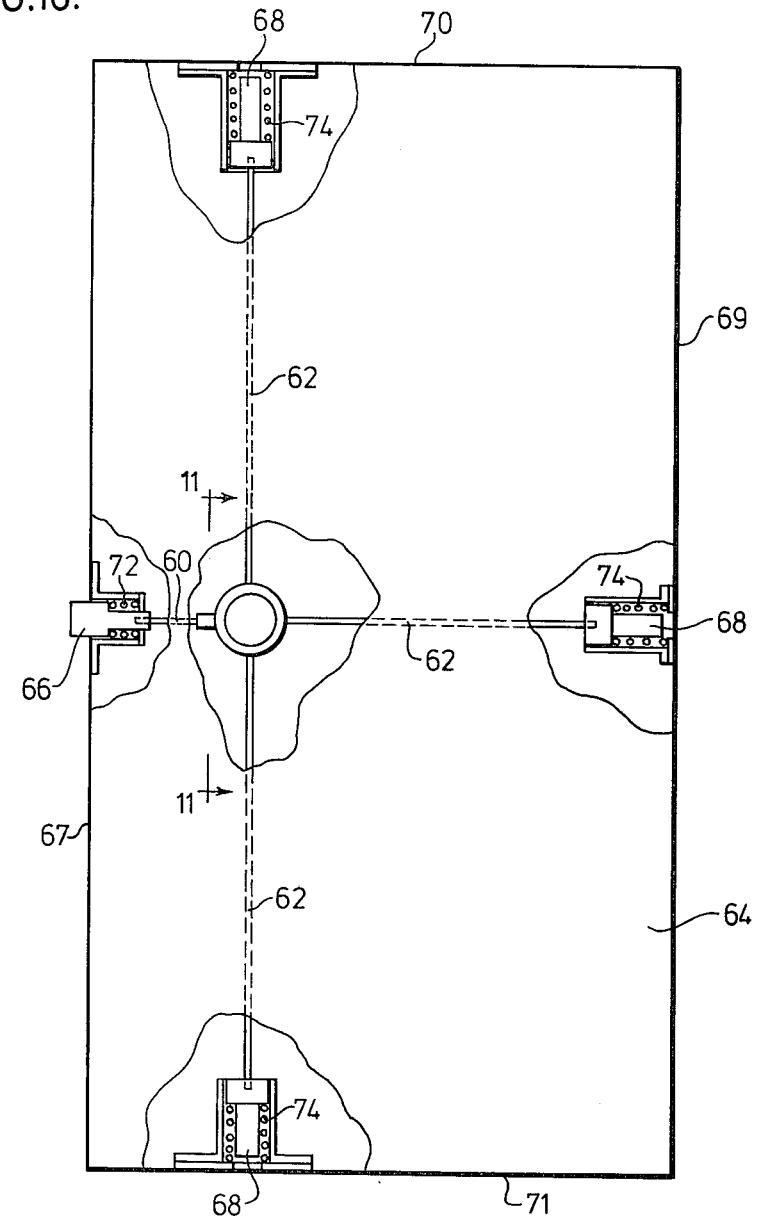
FIG. 10 is an enlargement of FIG. 5 with certain portions of the door cut away to expose the locking arrangement within the door.

The second locking means includes locking portions 37 provided with pins 39. Each of the locking bolt portions is provided with a threaded aperture 43 for threadably engaging bars 62 as shown in FIGS. 4, 5 and 10. Latch member component 31 includes threaded aperture 32 for threadably engaging bar 60 as shown in FIGS. 4, 5 and 10. The latch member component has a semi-circular end 35 while the locking bolt portions have semi-circular ends 41, adapted for mating with rounded shaft 5 when the first and second locking means are both in the unlocking position.

Housing 29 also includes a second housing component 52 provided with 3 elongated slots 53 and a central rounded aperture 54 through which rounded shaft 5 is fitted. Pins 39 of locking bolt portions 37 extend through the slots 53 of component 52. Both the latch member component and the locking bolt portions are sandwiched between components 19 and 52 in guides 55 and 57 respectively. The guides guide the movement of the latch member component and the locking bolt portions to and from the locking position.

Provided between plate 3 and component 52, is a cam plate 45. Cam plate 45 includes a rounded central aperture 47 for rotatably mounting the cam plate over rounded shaft 5. The cam plate is also provided with cam grooves 49, presenting camming surfaces 48 and 50. The cam grooves preferably extend to the periphery of the cam plate and are provided at their open end with a recessed locking portion 51. When the lock is assembled, pins 39 of locking bolt portions 37 extend through slots 53 into cam grooves 49.

The cam plate is also provided with a lug 56, which extends into slot 9 provided on plate 3. As can be appreciated, the location of the lug and slot could easily be interchanged such that the lug is provided on plate 3 and the slot is provided on cam plate 45.

Figure 11:
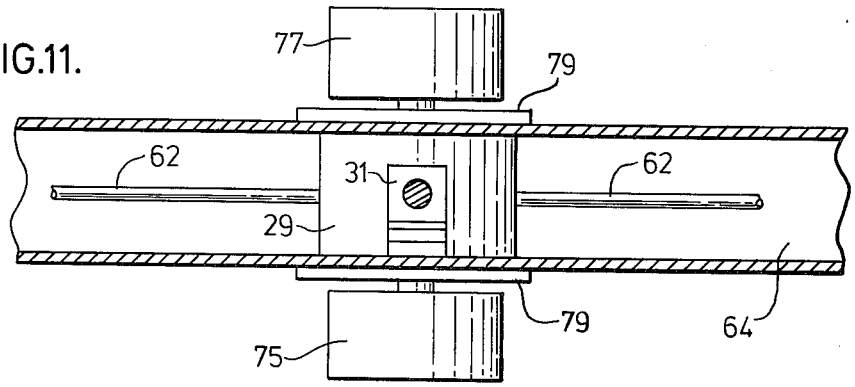
FIG. 11 is an enlarged sectional view taken along the lines 11—11 of FIG. 10.

FIGS. 4, 5, 10 and 11 show the lock when installed in a door 64. Door 64 is one which would be typically hinge mounted along edge 69 to a building or structure. As is best shown in FIG. 10, latch member 66 is located on the edge 67 of the door opposing the hinge mounted edge 69. Locking bolts 68 are located at edges 70, 69 and 71 distinct from edge 67. Bar 60 penetrates through a drilling in the interior of the door from the latch member component to the actual latch member. Bars 62 penetrate through similar drillings from the locking bolt portions to the actual locking bolts 68. It will be noted from FIG. 10, which shows the locking arrangement in a zero or first position, that the latch member is biased to the locking position by spring 72, while the locking bolts are biased to the unlocking position by springs 74. As is best shown in FIGS. 3 and 11, plates 79 are provided to secure the lock within the door. Door knob 75 is provided with keyhole 83 for purposes of locking the lock.

Figure 9:
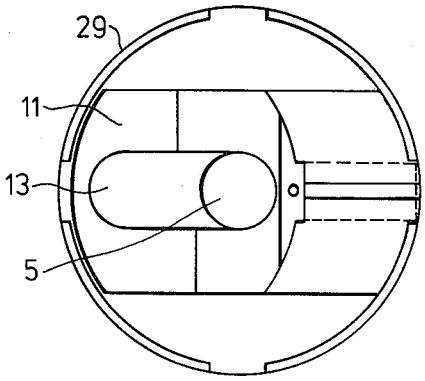
FIG. 9 is a view similar to FIG. 8 showing the first locking means in the unlocking position.

The operation of the lock is as follows. When the lock is in the first or zero position as shown in FIG. 10, latch member 66 extends from the edge 67 of the door while locking bolts 68 are withdrawn into the unlocking position within the door. In this position, lug 10 provided on plate 1 abuts end wall 16 of recessed portion 15 on sliding plate 11. At the other end of the lock, lug 56 provided on cam plate 45 is located adjacent end wall 12 of slot 9 in second plate 3. To move the latch member to the unlocking position without disturbing the locking bolts, door knob 75 provided at the plate 1 end of the lock, is rotated in the clockwise direction, thereby rotating plates 1 and 3 as well as shaft 5 with the door knob. This of course occurs as a result of the penetration of square shaft 81 through rounded shaft 5. As plate 1 is rotated in the clockwise direction, lug 10 in contact with end wall 16 of recessed portion 15, forces sliding plate 11 to slide over shaft 5 to a position where latch member 66 is in the unlocking position as shown in FIG. 9. The movement of the sliding plate in the withdrawing direction is restricted as a result of the engagement between pin 17 and the closed end of slot 21.

As door knob 75 is turned in the clockwise direction, shaft 5 rotates with respect to cam plate 45, due to the positioning of lug 56 within slot 9 of plate 3. Therefore, when the operating means is rotated from the first position in the clockwise direction, lug 56 is freely moveable within slot 9 and disengaged from the operating means. In addition, the cam plate is held against rotation because the frictional resistance between the cam plate and the housing is greater than the frictional resistance between the cam plate and rounded shaft 5.

Figure 7:
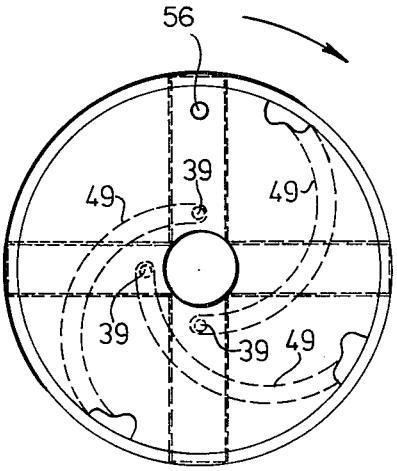
FIG. 7 is a view similar to FIG. 6 showing both the first and second locking means in the unlocking position.

FIG. 7 shows the relative positions of pins 39 in cam grooves 49 both before and after rotation of door knob 75 from the zero position to the position where the latch member is in an unlocking position. The locking bolts are fully withdrawn in the zero position, and pins 39 are located at the closed ends of the cam grooves. Slot 9 on plate 3 has a length which permits full withdrawal of latch member 66 without any engagement between plate 3 and the lug provided on cam plate 45.

Figure 8:
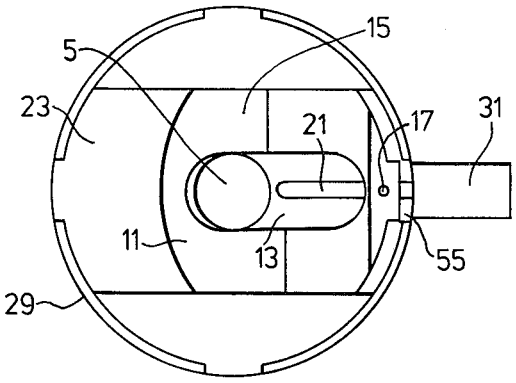
FIG. 8 is a sectional view taken along the lines 8—8 of FIG. 3 showing the first locking means in the locking position.

However, when door knob 75 is rotated in the counterclockwise direction from the zero position, latch member 66 remains in the locking position while locking bolts 68 are thrown from the unlocking position to a locking position. As mentioned above, in the zero position, lug 10 on plate 1 abuts end wall 16 of sliding plate 15 while lug 56 on plate 45 abuts end wall 12 of slot 9 in plate 3. Therefore, when door knob 75 is rotated in the counterclockwise direction, plate 3 engages the lug on the cam plate, such that the cam plate rotates with plate 3, while at the same time, lug 10 is freely moveable in recessed portion 15 of the sliding plate. As cam plate 45 is rotated with the operating means, camming surfaces 48 in cam grooves 49 drive pins 39 on lock bolt portions 37 outwardly from the unlocking position to the locking position. The length and pitch of the cam grooves are such that pins 39 are moved relatively easily from the positions shown in FIG. 7 to the positions shown in FIG. 6. Latch 66 remains in the locking position as shown in FIG. 8 due to the fact that lug 10 is freely moveable without engaging the sliding plate. Spring 72 of course assists in maintaining the latch in the locking position.

Figure 6:
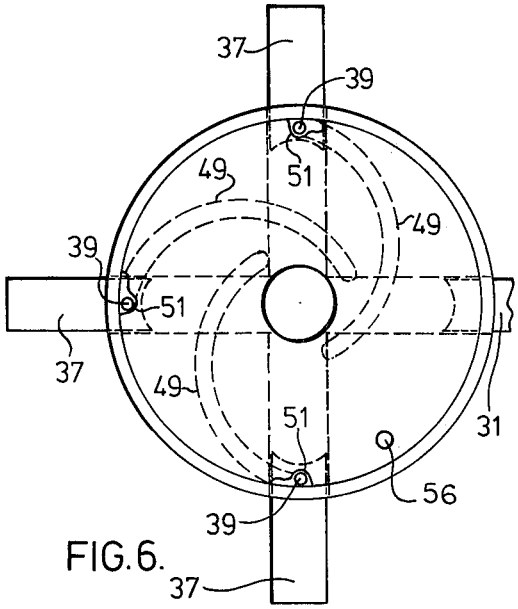
FIG. 6 is a sectional view taken along the lines 6—6 of FIG. 3 showing both the first and second locking means in the locking position.

Door knob 75 is restricted in its counterclockwise movement at the point where the locking bolt portions are fully extended from the lock housing. When the locking bolt portions are in the fully extended position, pins 39 are fitted within locking recesses 51 of cam grooves 49 and held there due to the provision of springs 74 which tend to drive the locking bolts and associated components back to the unlocking position. FIG. 6 shows the relative positions of the locked parts when door knob 75 has been rotated to the fully locking position. The door knob can of course be locked in this position.

In order to return the lock to the zero position, door knob 75 must be rerotated as far as possible in the clockwise direction and released. This withdraws the locking bolts from the locking position and returns the latch member to the locking position. Upon initial rerotation in the clockwise direction, the locking bolts remain in their locking positions until end wall 14 of slot 9 engages lug 56 on cam plate 45. Lug 10 on plate 1 then engages end wall 16 of recessed portion 15 such that upon further rotation of the door knob, in the clockwise direction, sliding plate 11 and latch member component 31 are withdrawn to the unlocking position while cam plate 45 rotates in the clockwise direction with plate 3, due to the engagement between lug 56 and end wall 14 of slot 9. As the cam plate begins to rotate in the clockwise direction, pins 39 are forced out of locking recesses 51 and back into the lock by camming surfaces 50 of cam grooves 49. When the door knob has been turned as far as possible in the clockwise direction, both the latch member and the locking bolts will be completely withdrawn. Upon releasing the door knob, the latch member will return to the locking position due to the provision of spring 72 while the locking bolts remain in the unlocking position.

As will be appreciated from the above, the lock according to this invention, is one which can be used as a conventional lock by persons leaving their premises over a relatively short period of time and which can also be used as a maximum security lock by persons leaving their premises over an extended period of time. If for instance one wishes to take a short trip to the store or to a neighbor's home, the lock is simply locked in the zero position which it naturally assumes due to the provision of the various springs in the lock. If however, one wishes to take an extended vacation, the lock can be moved to a mzximum security position by simply rotating the door knob and locking it in that position. When in the maximum security position, the locking bolts as well as the latch member are in the locking position so that it is not simply a matter of prying the latch open or removing the door hinges in order to enter the building through the door. Furthermore, the movement of the locking bolt and the latch member to the locking position, is achieved very quickly and easily by a single operating means. The lock is very neat in appearance and easily installed at any desired position in both existing and new doors.

Although various preferred embodiments of the invention have been described herein in detail, it will be apparent to those skilled in the art that variations may be made thereto without departing from the spirit of the invention or the scope of the appended claims.

The embodiments of the invention in which an exclusive property or privilege is claimed are defined as follows:

1. A lock provided with first locking means, second locking means and rotatable operating means for operating said first and second locking means, and operating means being rotatable in both directions from a first position in which said first locking means is spring loaded to remain in a locking position and said second locking means is spring loaded to remain in an unlocking position, the arrangement being such that when said operating means is rotated in one direction from said first position, said first locking means is moved to an unlocking position without disturbing said second locking means and also being such that when said operating means is rotated in the opposite direction from said first position, said first locking means is maintained in its locking position and said second locking means is moved to a locking position.

2. A lock as claimed in claim 1 when installed in a door mounted by hinges along one edge to a structure.

3. A lock as claimed in claim 2 wherein said first locking means comprises a latch provided at the edge of said door opposing said hinges.

4. A lock as claimed in claim 3 wherein said second locking means comprises at least one bolt provided at an edge of said door distinct from said edge opposing said hinges.

5. A lock as claimed in claim 3 wherein said second locking means comprises three bolts provided at the edges of said door distinct from said edge opposing said hinges.

6. A lock as claimed in claim 5 wherein said operating means is a door knob.

7. A lock comprising rotatable operating means, first locking means, second locking means and camming means for moving said second locking means to and from a locking position, said operating means being rotatable in both directions from a first position in which said first locking means is spring loaded to remain in the locking position and said second locking means is spring loaded to remain in the unlocking position, the arrangement being such that when said operating means is rotated in one direction from said first position, said first locking means is moved to the unlocking position, said camming means is disengaged from said operating means and said second locking means is maintained in the unlocking position by said camming means and also being such that when said operating means is rotated in the opposite direction from said first position, said first locking means is maintained in the locking position, said camming means is engaged by said operating means and said second locking means is moved against spring pressure to the locking position.

8. A lock as claimed in claim 7 wherein said rotatable operating means includes a first plate, a second plate and a rounded shaft extending between and secured to said first and second plates, said camming means being rotatably mounted on said rounded shaft and being engaged with said second plate when said operating means is rotated in said opposite direction.

9. A lock as claimed in claim 8 wherein said first locking means comprises a slotted plate sliding mounted on said rounded shaft, said slotted plate being provided at one end with a latch member and having a recessed portion, said first plate being provided with lug extending into said recessed portion, said lug abutting an end wall of said recessed portion when said operating means is rotated in said one direction for sliding said slotted plate and latch member from the locking to the unlocking position and being freely moveable in said recessed portion when said operating means is rotated in said opposite direction.

10. A lock as claimed in claim 9 wherein said camming means comprises a cam plate having a cam groove presenting camming surfaces and said second locking means comprises a locking bolt provided with a pin extending into said cam groove for camming over said camming surfaces to move said locking bolt to and from the locking position.

11. A lock as claimed in claim 9 wherein said camming means comprises a cam plate having three cam grooves each presenting camming surfaces and said second locking means comprises three spaced locking bolts provided with pins extending into said cam grooves for camming over said cam surfaces to move said locking bolts to and from the locking position.

12. A lock as claimed in claim 11 wherein said cam grooves extend to and open at the periphery of said cam plate, each groove being provided at its open end with a locking recess for receiving the pin on its respective locking bolt when said bolts are in their locking positions.

13. A lock as claimed in claim 11 wherein said second plate is provided with an elongated slot and said cam plate is provided with a lug extending into and positioned in said elongated slot such that said second plate moves relative to said cam plate when said operating means is rotated in said one direction from said first position and such that the lug on said cam plate engages an end wall of said elongated slot and rotates said cam plate with said second plate when said operating means is rotated in said opposite direction from said first position.

14. A lock as claimed in claim 11 when assembled in a lock housing, said lock housing being provided with guides for guiding said latch member and said locking bolts to and from the locking position.

15. A lock as claimed in claim 14 when installed in a door mounted by hinges along one edge to a structure, said latch member being located at the edge of said door opposing said hinges, said locking bolts being located at the edges of the door distinct from the edge opposing the hinges.

16. A lock as claimed in claim 15 wherein said rotatable operating means further includes a pair of door knobs located on opposing sides of the door.

17. A lock as claimed in claim 14 wherein said first and second plates are circular and located at opposite ends of said housing.

* * * * *